US009884464B2

(12) United States Patent
Groth et al.

(10) Patent No.: US 9,884,464 B2
(45) Date of Patent: Feb. 6, 2018

(54) METHOD FOR SETTING UP AND OPERATING A PRESS

(71) Applicant: Fette Compacting GmbH, Schwarzenbek (DE)

(72) Inventors: Andreas Groth, Schwarzebek (DE); Andreas Teetzen, Schwarzenbek (DE)

(73) Assignee: Fette Compacting GmbH, Schwarzenbek (DE)

( * ) Notice: Subject to any disclaimer, the term of this patent is extended or adjusted under 35 U.S.C. 154(b) by 462 days.

(21) Appl. No.: 14/687,143

(22) Filed: Apr. 15, 2015

(65) Prior Publication Data

US 2015/0298416 A1 Oct. 22, 2015

(30) Foreign Application Priority Data

Apr. 16, 2014 (DE) ..... 10 2014 105 429

(51) Int. Cl.

| | |
|---|---|
| ***B30B 15/00*** | (2006.01) |
| ***B22F 3/02*** | (2006.01) |
| ***B30B 1/18*** | (2006.01) |
| ***B30B 11/02*** | (2006.01) |
| ***B30B 15/14*** | (2006.01) |

(52) U.S. Cl.

CPC ..... *B30B 15/007* (2013.01); *B22F 3/02* (2013.01); *B30B 1/181* (2013.01); *B30B 11/02* (2013.01); *B30B 15/148* (2013.01)

(58) Field of Classification Search

CPC ..... B30B 15/007; B30B 15/14; B30B 15/148
See application file for complete search history.

(56) References Cited

U.S. PATENT DOCUMENTS

| | | | | |
|---|---|---|---|---|
| 3,677,009 | A * | 7/1972 | Thatcher | B21D 5/02 60/328 |
| 2005/0039510 | A1* | 2/2005 | Futamura | B30B 1/186 72/20.1 |
| 2007/0193331 | A1 | 8/2007 | Futamura et al. | |

(Continued)

FOREIGN PATENT DOCUMENTS

| | | |
|---|---|---|
| DE | 10 2011 102 178 A1 | 11/2011 |
| DE | 10 2011 116 552 A1 | 4/2013 |
| DE | 10 2012 019 312 A1 | 4/2014 |

(Continued)

*Primary Examiner* — Colleen Dunn
*Assistant Examiner* — Jeremy Jones
(74) *Attorney, Agent, or Firm* — Young Basile Hanlon & MacFarlane, P.C.

(57) ABSTRACT

A press comprises a press frame, at least one upper punch plate with at least one upper press punch held on it and/or at least one lower punch plate with at least one lower press punch held on it. A die plate has at least one receiver for powdered material to be pressed by the press punches. At least two upper drives are mechanically coupled in the operation of the press, engaging at the upper punch plate for moving the upper press punch in the vertical direction and/or at least two lower drives mechanically coupled in the operation of the press, engaging on the lower punch plate and/or the die plate for moving the lower press punch and/or the die plate in the vertical direction. A method for setting up and operating the press for producing a pellet made of the powdered material, in particular metal powder, is described.

12 Claims, 1 Drawing Sheet

(56) References Cited

U.S. PATENT DOCUMENTS

2014/0287078 A1 9/2014 Behns et al.

FOREIGN PATENT DOCUMENTS

| | | | | |
|---|---|---|---|---|
| GB | 826 468 | A | 1/1960 | |
| JP | 2003-230996 | A | 8/2003 | |
| JP | 2006-213548 | A | 8/2006 | |
| JP | 2006-297477 | A | 11/2006 | |
| JP | 2012-125810 | A | 7/2012 | |
| WO | WO 2011045303 | A2 * | 4/2011 | ..... B22F 3/03 |
| WO | 2013/178355 | A1 | 12/2013 | |

* cited by examiner

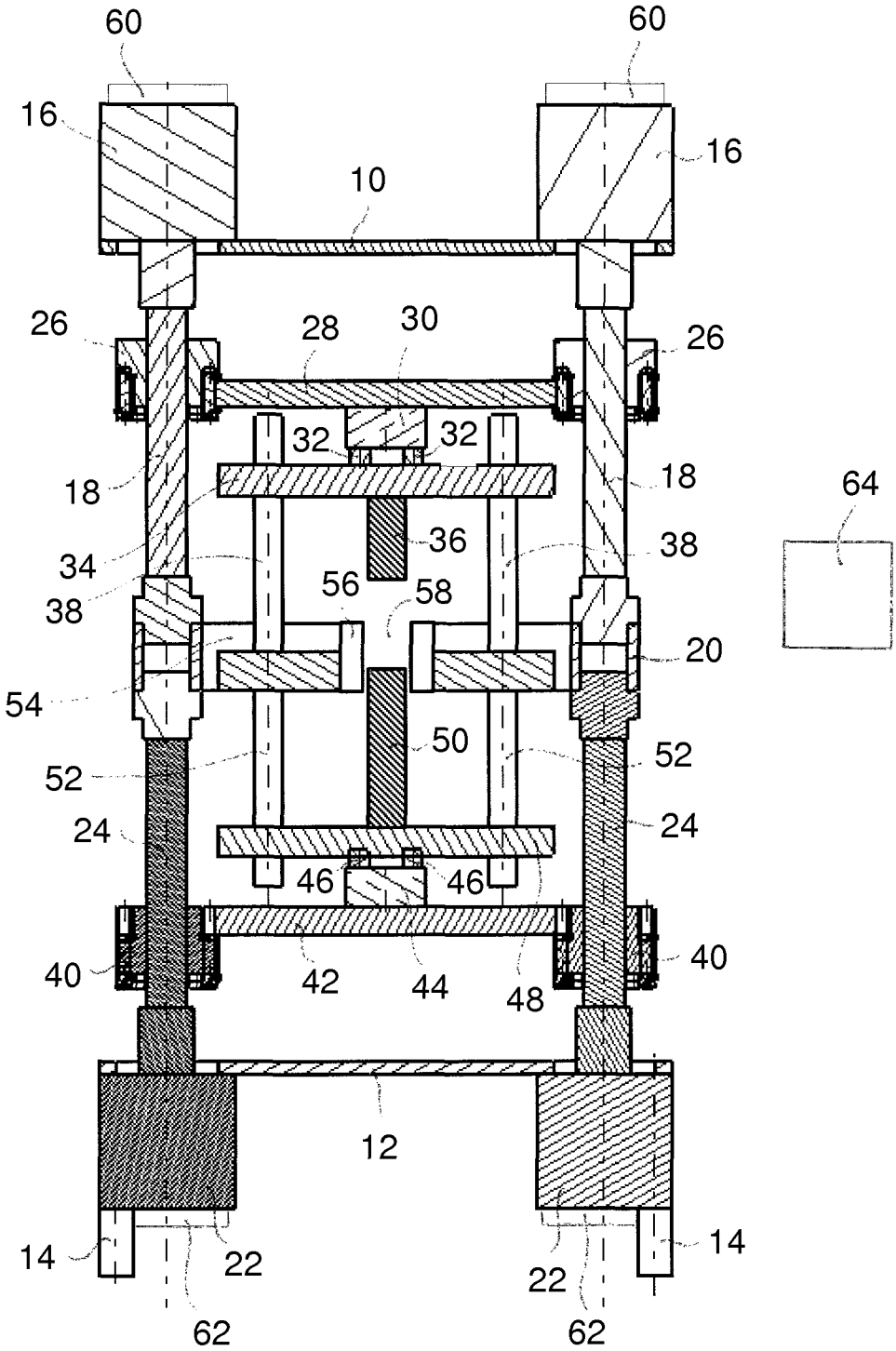
60
60
16
16
10
26
28
30
26
32
32
18
18
64
36
34
38
38
56
58
20
54
50
52
52
24
24
46
46
40
42
44
48
40
12
14
22
14
22
62
62

METHOD FOR SETTING UP AND OPERATING A PRESS

TECHNICAL FIELD

The invention relates to a method for setting up and operating a press for producing a pellet made of powdered material, in particular metal powder.

BACKGROUND

A press is known for example from DE 10 2011 116 552 A1. For example, metal powder is pressed into pellets with such a press. Two upper drives or two lower drives are thereby frequently provided, wherein the upper drives jointly move an upper press punch and the lower drives jointly move a lower press punch in the vertical direction. It is also known that the lower drives jointly move the die plate. So that the upper or respectively lower drives can act respectively jointly on the pressing tools, the upper or respectively lower drives must be respectively mechanically coupled with each other. In the press known from DE 10 2011 116 552 A1, this occurs for example for the upper drives through a force transmission bridge connected with an upper punch plate holding the upper press punch. A corresponding force transmission bridge is provided for the lower drives. The upper or respectively lower drives are thereby respectively fastened on opposite-lying ends of the force transmission bridge. After the mechanical coupling, the drives must move synchronously in order to avoid tilting or twisting and thus damage to the mechanical coupling or other components of the press to the greatest extent possible. For this, during commissioning of the press before the mechanical coupling, the drives can be moved individually so that a mechanical coupling is possible without tilting or twisting of the mechanical coupling. The drives are then only run synchronously at a synchronized speed.

SUMMARY

When operating the press, deviations between the drives may occur, for example due to a drive lag in an emergency stop situation or a loss of power. This is not necessarily detected by the operator of the press, in particular if they are comparatively small deviations. If the drives then continue to be synchronously operated by the controller of the press, the once generated deviations from the synchronized speed and thus the tilting or respectively twisting of the mechanical coupling persist. This asynchronous state of the drives can become larger with each fault and thus damage the mechanical coupling and other components of the press, such as drive spindles, adapters or pressing tools. The operator of the press must thus regularly check the synchronized speed of the drives manually. A synchronization of the drives with each other is thereby only possible with considerable measurement effort; in particular, an exact path measurement of the drives or respectively a distance measurement to a machine zero point.

According to the teachings herein, however, a mechanical coupling of the drives is possible without risk of damage to the mechanical coupling or other components of the press with less effort than that previously described.

A press may comprise a press frame, at least one upper punch plate with at least one upper press punch held on it and/or at least one lower punch plate with at least one lower press punch held on it and a die plate with at least one receiver for powdered material to be pressed by the upper and/or lower press punch. The press may also comprise at least two upper drives mechanically coupled in the operation of the press, engaging at the upper punch plate for moving the upper press punch in the vertical direction and/or at least two lower drives mechanically coupled in the operation of the press, engaging on the lower punch plate and/or the die plate for moving the lower press punch and/or the die plate in the vertical direction.

In a setup procedure of such a press according to the teachings herein, upper drives are respectively moved into a coupling position in which they are coupled mechanically and/or lower drives are respectively moved into a coupling position in which they are coupled mechanically. Before a pressing procedure, the positions of the mechanically coupled upper drives are measured and, if a maximum permissible position deviation is exceeded, at least one of the upper drives is moved so that the maximum permissible position deviation is no longer exceeded. Alternatively, or in addition thereto, the positions of the mechanically coupled lower drives are determined, and, if a maximum permissible position deviation is exceeded, at least one of the lower drives is moved so that the maximum permissible position deviation is no longer exceeded.

The press used in the method above may have a press frame, for example with an upper and a lower holding plate, which are interconnected by several vertical spacers. A bearing element can be arranged between the upper and the lower holding plates. Moreover, a tool guiding unit or respectively an adapter is provided with at least one upper press punch, which is fastened on an upper punch plate, and/or with a lower press punch, which is fastened on a lower punch plate, as well as with a die plate with a receiver for powdered material to be pressed by the upper and/or lower press punches. The powdered material may be, for example, metal powder or also ceramic powder. The tool guiding unit can be arranged on the bearing element. Moreover, the press has at least two upper drives and/or at least two lower drives. The upper drives drive the upper press punch and/or the lower drives drive the lower press punch or the die unit. The drives can be supported during operation on the bearing element, which can be designed for example as a support frame.

The press can stand on feet or directly on the ground via the lower retaining plate of the press frame. The press generally comprises at least one upper punch and at least one lower punch, which interact in the receiver of the die plate for pressing the filled powder. However, it is also possible to provide a pressing, for example, only from above using only one upper punch if the receiver of the die plate has a closed bottom. As explained, the lower drives can drive a lower press punch or a die plate in the vertical direction. Thus, it is possible to operate the press both in an ejection method, in which the die plate is stationary and the upper and lower punches move with respect to the die plate, as well as in the pull-off method, in which the lower punch is stationary and the die plate and the upper punch are movable.

In the method according to the teachings herein, the upper drives and/or the lower drives are respectively moved in a setup procedure before the mechanical coupling so that a mechanical coupling is possible without tilting or respectively twisting the components involved in the mechanical coupling as far as possible. In this coupling position, the upper drives are mechanically coupled and/or the lower drives are mechanically coupled.

Before a pressing procedure is performed with the press, the proper position of the drives is checked. This can take place in particular before each pressing procedure. It can also take place during a pressing procedure or at other times. For this, the positions of the upper and/or the lower drives are measured for example with a position measuring device integrated into the drives. The maximum permissible position deviation forms a threshold value, which would lead to an impermissible tilting or respectively twisting of the components of the mechanical coupling. The position deviation can be a deviation between the measured positions of the upper drives and/or a position deviation between the measured positions of the lower drives. It can also be a deviation to a respective target position specified for the upper drives and/or the lower drives. As already mentioned, the maximum permissible position deviation is determined such that, up until this position deviation is reached, a just acceptable tilting or respectively twisting of the mechanical coupling is present. The tilting or twisting may exist at, for example, the connection of the drives with a force transmission bridge or respectively the force transmission bridge itself or its connection to the respective punch plate or respectively the die plate.

Thus, the synchronized speed of the drives is checked before the pressing procedure. If an impermissible position deviation is determined, the drives are synchronized again by the machine controller of the press in that at least one of the upper drives and/or at least one of the lower drives is moved far enough that a present position deviation and thus tilting or respectively twisting of the mechanical coupling again assumes an acceptably low value, preferably the value zero. Only after this procedure is complete, the movement of the drives is started for the actual pressing procedure of the press.

The activation of the measuring devices for measuring the position of the drives and the activation of the drives for moving one or more drives can take place as explained in particular through the machine controller of the press. According to the invention, the upper drives or respectively the lower drives thus only need to be aligned during the setup procedure taking place in the course of the commissioning. Deviations in the synchronized speed potentially occurring during operation are then automatically detected and compensated for by the machine controller. The effort during operation of the press, in particular for avoiding an impermissible tilting or twisting of the mechanical coupling and thus damage to components, is considerably simplified compared to the art previously described.

According to one embodiment, the coupling position and a maximum permissible position deviation from the coupling position are respectively saved in the setup procedure for the upper drives and/or the coupling position and a maximum permissible position deviation from the coupling position are respectively saved in the setup procedure for the lower drives.

According to one implementation, at least before a pressing procedure, a first of the mechanically coupled upper drives is moved into its coupling position and a position deviation of the second of the upper drives to its coupling position is measured and is moved when the saved maximum permissible position deviation from the coupling position of the second of the upper drives is exceeded such that the maximum permissible position deviation is no longer exceeded. Alternatively, or in addition thereto, at least before a pressing procedure, a first of the mechanically coupled lower drives is moved into its coupling position and a position deviation of the second of the lower drives to its coupling position is measured and is moved when the saved maximum permissible position deviation from the coupling position of the second of the lower drives is exceeded such that the maximum permissible position deviation is no longer exceeded.

In the case of these embodiments, the coupling position of the upper drives and/or the lower drives is saved as a machine zero point. In their coupling position, the upper drives or respectively the lower drives are each positioned the same to the greatest extent possible so that no tilting or respectively twisting of the mechanical coupling is present as far as possible. A maximum permissible position deviation from the coupling position is simultaneously saved for each of the drives. Before a pressing procedure, one of the mechanically coupled upper drives or respectively one of the mechanically coupled lower drives is moved into its coupling position. In the case of a proper synchronized speed, the other of the upper or respectively lower drives would then have to be located in its coupling position. This is checked metrologically. If a position deviation of the other of the upper or respectively lower drives with respect to its coupling position is determined, this is compared to the previously saved maximum permissible position deviation. If the maximum permissible position deviation is exceeded, the other of the upper or respectively lower drives is correspondingly moved in order to re-establish the desired synchronized speed. It is in particular possible that the second of the upper drives is also moved into its coupling position when the saved maximum permissible position deviation from the coupling position is exceeded and/or that the second of the lower drives is also moved into its coupling position when the saved maximum permissible position deviation from the coupling position is exceeded.

According to the teachings herein, the maximum permissible position deviation can generally also be specified such that any position deviation from the specified synchronized speed, in particular from the specified coupling position, is defined as impermissible and is correspondingly compensated for by the machine controller by moving the respective drive.

The measuring of the positions of the mechanically coupled upper drives and/or the measuring of the positions of the mechanically coupled lower drives can take place automatically before a pressing procedure, in particular automatically before each pressing procedure. As already mentioned, the measuring can be triggered for example by the machine controller of the press. The movement of at least one of the upper drives when a maximum permissible position deviation is exceeded and/or the movement of at least one of the lower drives when a maximum permissible position deviation is exceeded can also take place automatically. In turn, this can take place in particular automatically before each pressing procedure, triggered for example by the machine controller of the press. The pressing procedure is only released and executed after proper checking or respectively re-establishment of the synchronized speed.

The exceeding of a maximum permissible position deviation can be displayed by a warning signal. This can be an optical or an acoustic warning signal.

It is also possible that the movement of at least one of the upper drives when a maximum permissible position deviation is exceeded and/or the movement of at least one of the lower drives when a maximum permissible position deviation is exceeded takes place after confirmation by an operator. In this case, an operator confirms, for example after a warning signal, that the re-establishment of the synchronized speed of the drives, in particular the movement of the drives respectively into their coupling position, should be performed. This is thus a semi-automatic variant.

The upper drives and/or the lower drives can be electric drives, in particular electric spindle drives. Spindle drives are particularly suitable since they can transfer very high forces in a precise manner. Moreover, the vertical position of the spindle drives is measurable very exactly for example via a measurement of the rotational position of the spindle drives.

According to a further embodiment, the upper drives are mechanically coupled via an upper force transmission bridge acting on the upper punch plate and/or that the lower drives are mechanically coupled via a lower force transmission bridge acting on the lower punch plate and/or the die plate. The upper drives or respectively the lower drives can be fastened, for example screwed, for example on opposite-lying ends of the upper force transmission bridge or respectively of the lower force transmission bridge. The screw connection can take place if necessary via elastic compensation elements for compensating for a certain deviation from the synchronized speed of the drives and an associated tilting of the force transmission bridge. The upper or respectively lower force transmission bridge can be connected with the upper or respectively lower punch plate or respectively die plate via a force transmission element, which can be arranged for example centrally on the respective force transmission bridge.

According to a further embodiment, respectively one spindle nut of the upper spindle drives can be fastened on the upper force transmission bridge and/or respectively one spindle nut of the lower spindle drives can be fastened on the lower force transmission bridge. Electric drive motors of the elastic drives can be fastened for example on the upper or respectively lower holding plate of the press frame. In the aforementioned embodiment, the spindles can respectively be permanently arranged axially and coupled in a rotatable manner with the drive motors. The spindle nuts and the force transmission bridges connected with them are then moved axially during a rotation of the spindles. However, alternatively, it is also possible that the spindles of the spindle drives are fastened on the force transmission bridge and the spindle nuts are permanently arranged axially and coupled in a rotatable manner with the drive motor. In this case, the respective spindles and the force transmission bridges connected with them are moved axially during a rotation of the spindle nuts moved by the drive motor.

BRIEF DESCRIPTION OF THE DRAWINGS

An exemplary embodiment of the invention is explained in greater detail below with reference to a figure wherein:

FIG. 1 is a schematic view of a press used in a method according to the exemplary embodiment.

DETAILED DESCRIPTION

The press has a press frame with an upper retaining plate 10 and a lower retaining plate 12. The upper retaining plate 10 and the lower retaining plate 12 can be interconnected via vertical spacers (not shown in greater detail). With the lower retaining plate 12, the press stands on feet 14 on the ground. In the example shown, the press has two upper drives and two lower drives. The upper and lower drives here are respectively electric drives. The upper drives each have an upper electric drive motor 16 fastened on the upper retaining plate 10, which rotatably drives an upper, axially fixed spindle 18. The upper spindles 18 are respectively supported on a support frame 20 on its end facing away from the drive motors 16. Correspondingly, the lower drives each have a lower electric drive motor 22 arranged on the lower retaining plate 12, wherein the lower electric drive motors 22 respectively rotatably drive a lower, axially fixed spindle 24. The lower spindles 24 are also supported on the support frame 20. Moreover, the upper drives each have a spindle nut 26 running on the upper spindles 18. The upper spindle nuts 26 are mechanically coupled with each other via an upper force transmission bridge 28. In particular, the upper spindle nuts 26 are screwed with opposite-lying ends of the upper force transmission bridge 28, if applicable via elastic compensation elements. The upper force transmission bridge 28 is connected with an upper punch plate 34 via a central force transmission element 30 and two further compensation elements 32. An upper press punch 36 is fastened on the upper punch plate 34. The upper punch plate 34 is guided in the vertical direction on vertical guide columns 38.

Correspondingly, the lower drives each have a lower spindle nut 40 guided on the lower spindles 24. The lower spindle nuts 40 are in turn screwed on opposite-lying ends of a lower force transmission bridge 42, if applicable via elastic compensation elements. The lower force transmission bridge 42 is connected with a lower punch plate 48, which carries a lower press punch 50, via a lower force transmission element 44 and compensation elements 46. The lower punch plate 48 is also guided in the vertical direction on vertical guide columns 52. The vertical guide columns 38, 52 are supported on a die plate 54 fastened on the support element or frame 20. The die plate 54 has a die 56, which forms a receiver 58 for powder to be pressed with the press, for example metal powder. During operation, the upper punch 36 and the lower punch 50 work together with the receiver 58 to press the powder filled into the receiver 58 into a pellet. For this, the upper spindle nuts 26 are moved in the vertical direction by rotation of the upper spindles 18 and the lower spindle nuts 40 by rotation of the lower spindles 24. This arrangement is known.

FIG. 1 also shows position measuring devices 60 for measurement of the position of the upper drives. The position measurement can take place for example by measuring the rotational position of the upper spindles 18. Corresponding position measuring devices 62 for the position measuring of the lower drives are designed identically to the position measuring devices 60 for the upper drives. Reference number 64 shows a machine controller of the press.

In the method according to the exemplary embodiment, the upper spindle nuts 26 are first moved into a coupling position while they are not yet connected with the upper force transmission bridge 28. The coupling position is selected such that a coupling takes place via the upper force transmission bridge 28 without a tilting or twisting of the components transmitting the mechanical coupling. In this state, the upper spindle nuts 26 are coupled with each other through the upper force transmission bridge 28. The coupling positions of the upper drives, in particular of their spindles 18 or respectively spindle nuts 26, assumed in this coupling are measured by the position measuring devices 60 and saved in the machine controller 64. Moreover, a maximum permissible position deviation from the coupling position for each of the upper drives, in particular their spindles 18 or respectively spindle nuts 26 is saved in the machine controller 64. In an analogous manner, the lower drives, in particular the lower spindle nuts 40 are moved into their respective coupling position and mechanically coupled with each other, wherein the coupling positions of both lower drives, in particular of their spindles 24 or respectively spindle nuts 40, are in turn measured by the position measuring devices 62 and saved together with a maximum permissible position deviation in the machine controller 64.

Each time before a pressing procedure is performed with the press, one of the upper drives, in particular one of the upper spindles 18 or respectively spindle nuts 26, is automatically moved into the coupling position by the machine controller 64 and the position of the other upper drive, in particular of the other upper spindle 18 or respectively spindle nut 26, is measured with the position measuring devices 60. The measurement results are given to the machine controller 64. In the case of a deviation from the saved coupling position, the corresponding upper electric drive motor 16 is automatically controlled by the machine controller 64 such that the drive deviating from the coupling position, in particular the spindle 18 or respectively spindle nut 26 deviating from the coupling position, is moved back into the coupling position. In an analogous manner, this is also performed automatically for the other drives, in particular the lower spindles 24 or respectively spindle nuts 40, by the machine controller 64. Only after the synchronized speed of the upper and lower drives has been checked and, if necessary, re-established in this manner, the pressing procedure is triggered by the machine controller 64.

The invention claimed is:

1. A method for setting up and operating a press for producing a pellet made of powdered material, wherein the press comprises:

a press frame;

at least one of an upper punch plate with an upper press punch or a lower punch plate with a lower press punch;

a die plate with at least one receiver for the powdered material to be pressed by the at least one of the upper press punch or the lower press punch; and at least one of at least two upper drives mechanically coupled in the operation of the press, engaging at the upper punch plate for moving the upper press punch in a vertical direction or at least two lower drives mechanically coupled in the operation of the press, engaging on at least one of the lower punch plate or the die plate for moving the at least one of the lower press punch or the die plate in the vertical direction, the method comprising:

in a setup procedure, performing at least one of respectively moving each of the at least two upper drives into a first coupling position in which they are coupled mechanically; or respectively moving each of the at least two lower drives into a second coupling position in which they are coupled mechanically;

before a pressing procedure, performing at least one of:

measuring current positions of the at least two upper drives, and if a first maximum permissible position deviation is exceeded, moving at least one of the at least two upper drives so that the first maximum permissible position deviation is no longer exceeded; or measuring current positions of the at least two lower drives are determined, and if a second maximum permissible position deviation is exceeded, moving at least one of the at least two lower drives so that the second maximum permissible position deviation is no longer exceeded.

2. The method according to claim 1, further comprising at least one of:

saving the first coupling position and the first maximum permissible position deviation from the first coupling position in the setup procedure for the at least two upper drives; or saving the second coupling position and the second maximum permissible position deviation from the second coupling position in the setup procedure for the at least two lower drives.

3. The method according to claim 2, further comprising, before the pressing procedure, performing at least one of:

moving a first of the at least two upper drives into the first coupling position, wherein measuring the current positions comprises measuring a position deviation of a second of the at least two upper drives from the first coupling position and wherein moving the at least one of the at least two upper drives comprises moving the second of the at least two upper drives when the first maximum permissible position deviation from the first coupling position is exceeded such that the first maximum permissible position deviation is no longer exceeded; or moving a first of the at least two lower drives into the second coupling position, wherein measuring the current positions comprises measuring a position deviation of a second of the at least two lower drives from the second coupling position and wherein moving the at least one of the at least two lower drives comprises moving the second of the at least two lower drives when the second maximum permissible position deviation from the second coupling position is exceeded such that the second maximum permissible position deviation is no longer exceeded.

4. The method according to claim 3, wherein moving the second of the at least two upper drives comprises moving the second of the at least two upper drives into the first coupling position when the first maximum permissible position deviation is exceeded by the position deviation of the second of the at least two upper drives and wherein moving the second of the at least two lower drives comprises moving the second of the at least two lower drives into the second coupling position when the second maximum permissible position deviation is exceeded by the position deviation of the second of the at least two lower drives.

5. The method according to claim 1, wherein at least one of measuring the current positions of the at least two upper drives or measuring the current positions of the at least two lower drives takes place automatically before the pressing procedure.

6. The method according to claim 1, further comprising:

displaying a warning signal when at least one of the first maximum permissible position deviation is exceeded or the second maximum permissible position deviation is exceeded.

7. The method according to claim 6, wherein, after displaying the warning signal, at least one of:

moving the at least one of the at least two upper drives when the first maximum permissible position deviation is exceeded takes place after a confirmation by an operator; or moving the at least one of the at least two lower drives when the second maximum permissible position deviation is exceeded takes place after the confirmation by the operator.

8. The method according to claim 1, wherein at least one of:

moving the at least one of the at least two upper drives when the first maximum permissible position deviation is exceeded takes place automatically; or moving the at least one of the at least two lower drives when the second maximum permissible position deviation is exceeded takes place automatically.

9. The method according to claim 1, wherein at least one of the at least two upper drives are electric drives or the at least two lower drives are electric drives.

10. The method according to claim 1, wherein the at least one of the at least two upper drives are electric spindle drives or the at least two lower drives are electric spindle drives.

11. The method according to claim 1, wherein at least one of the at least two upper drives are mechanically coupled via an upper force transmission bridge acting on the upper punch plate or the at least two lower drives are mechanically coupled via a lower force transmission bridge acting on at least one of the lower punch plate or the die plate.

12. The method according to claim 11, wherein at least one of:

each of the at least two upper drives is an upper electric spindle drive, or each of the at least two lower drives is a lower electric spindle drive; and wherein at least one of:

a spindle nut of the upper electric spindle drive is fastened on the upper force transmission bridge, or a spindle nut of the lower electric spindle drive is fastened on the lower force transmission bridge.

* * * * *